US009595783B2

(12) United States Patent
Pitzul

(10) Patent No.: US 9,595,783 B2
(45) Date of Patent: Mar. 14, 2017

(54) FLUID-TIGHT CONTACT WITH PERMANENTLY ELASTIC SEALANT

(71) Applicant: Kostal Kontakt Systeme GmbH, Luedenscheid (DE)

(72) Inventor: Uwe Pitzul, Hagen (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 14/869,220

(22) Filed: Sep. 29, 2015

(65) Prior Publication Data

US 2016/0020550 A1 Jan. 21, 2016

Related U.S. Application Data

(63) Continuation of application No. PCT/EP2014/056100, filed on Mar. 26, 2014.

(30) Foreign Application Priority Data

Mar. 30, 2013 (DE) ..... 10 2013 005 705

(51) Int. Cl.
*H01R 13/405* (2006.01)
*H01R 13/52* (2006.01)

(52) U.S. Cl.
CPC ..... *H01R 13/5202* (2013.01); *H01R 13/521* (2013.01); *H01R 13/5216* (2013.01)

(58) Field of Classification Search
CPC ..... H01R 13/652; H01R 43/24; H01R 13/03; H01R 13/521; H01R 13/5202
USPC ..... 439/736, 106, 606, 587, 886
See application file for complete search history.

(56) References Cited

U.S. PATENT DOCUMENTS 3,522,575 A 8/1970 Watson et al.
4,580,005 A * 4/1986 Minks ..... H01H 50/023 174/17.07
4,847,528 A * 7/1989 Eguchi ..... B29C 70/84 264/135
5,035,656 A * 7/1991 Patel ..... H01R 12/58 439/733.1

(Continued)

FOREIGN PATENT DOCUMENTS

CN 101557050 A 10/2009
DE 1765571 A1 7/1971

(Continued)

OTHER PUBLICATIONS

The International Bureau of WIPO, International Preliminary Report on Patentability for International Application No. PCT/EP2014/056100 issued Oct. 6, 2015.

(Continued)

*Primary Examiner* — Hae Moon Hyeon
(74) *Attorney, Agent, or Firm* — Brooks Kushman P.C.

(57) ABSTRACT

A fluid-tight via includes a plastic body, a flat contact, and a permanently elastic sealant. The plastic body is composed of a non-shrinking, duroplastic material. The flat contact has an intermediate region encapsulated by the plastic body. The intermediate region of the flat contact has a cross-sectional width which varies along an axial direction of the flat contact. The permanently elastic sealant fills cracks in interfaces between the plastic body and the flat contact.

11 Claims, 2 Drawing Sheets

(56) References Cited

U.S. PATENT DOCUMENTS

| | | | | |
|---|---|---|---|---|
| 5,122,075 | A * | 6/1992 | Kile | H01R 9/091 439/329 |
| 5,483,743 | A | 1/1996 | Armogan et al. | |
| 5,518,427 | A | 5/1996 | Kan et al. | |
| 6,506,083 | B1 * | 1/2003 | Bickford | H01R 13/533 439/281 |
| 6,582,251 | B1 * | 6/2003 | Burke | H01R 13/5202 439/589 |
| 6,821,162 | B2 * | 11/2004 | Mott | H01R 13/04 439/722 |
| 6,981,896 | B2 * | 1/2006 | Su | H01R 13/652 439/606 |
| 7,070,449 | B2 | 7/2006 | Miyazaki | |
| 7,249,971 | B2 * | 7/2007 | Burke | B29C 45/14639 439/589 |
| 7,638,721 | B2 * | 12/2009 | Rehbein | H01R 4/58 174/126.1 |
| 7,731,531 | B2 * | 6/2010 | Tsujino | H01R 4/029 29/858 |
| 7,901,247 | B2 * | 3/2011 | Ring | H01R 13/405 439/606 |
| 8,011,976 | B2 * | 9/2011 | Ooki | H01R 13/50 439/736 |
| 9,337,569 | B2 | 5/2016 | Kindermann et al. | |
| 2003/0087560 | A1 * | 5/2003 | Patwardhan | H01R 4/56 439/736 |
| 2004/0018780 | A1 | 1/2004 | Mott et al. | |
| 2004/0063360 | A1 * | 4/2004 | Kikuchi | B29C 45/0046 439/736 |
| 2004/0266261 | A1 | 12/2004 | Miyazaki | |
| 2009/0258521 | A1 | 10/2009 | Ooki | |
| 2011/0316372 | A1 | 12/2011 | Kobayashi et al. | |
| 2014/0256167 | A1 | 9/2014 | Kindermann et al. | |

FOREIGN PATENT DOCUMENTS

| | | | |
|---|---|---|---|
| DE | 9011269 | U1 | 8/1991 |
| DE | 4236320 | A1 | 5/1994 |
| DE | 69418564 | T2 | 12/1999 |
| DE | 10127488 | A1 | 1/2003 |
| DE | 102004030810 | A1 | 1/2005 |
| DE | 102009058525 | A1 | 6/2011 |
| DE | 102011121133 | A1 | 6/2013 |

OTHER PUBLICATIONS

European Patent Office, International Search Report for International Application No. PCT/EP2014/056100 mailed May 30, 2014.

The State Intellectual Property Office of People's Republic of China, The First Office Action of corresponding Chinese Patent Application No. 201480019497 dated Mar. 30, 2013.

The State Intellectual Property Office of People's Republic of China, The translation of the First Office Action of corresponding Chinese Patent Application No. 201480019497 dated Mar. 30, 2013.

The State Intellectual Property Office, The First Search Report for the corresponding Chinese Patent Application No. 201480019497 dated Sep. 29, 2015.

* cited by examiner

FLUID-TIGHT CONTACT WITH PERMANENTLY ELASTIC SEALANT

CROSS-REFERENCE TO RELATED APPLICATIONS

This application is a continuation of International Application No. PCT/EP2014/056100, published in German, with an International filing date of Mar. 26, 2014, which claims priority to DE 10 2013 005 705.1, filed Mar. 30, 2013; the disclosures of which are hereby incorporated in their entirety by reference herein.

TECHNICAL FIELD

The present invention relates to a fluid-tight contact implementation (i.e., a fluid-tight via) having a plastic body and a flat contact(s) in which the plastic body encapsulates a region of the flat contact and the encapsulated region of the flat contact has one or more cross-sectional changes.

BACKGROUND

DE 10 2009 058 525 A1 describes such a fluid-tight via. A region of the flat contact has a cross-sectional contour tapered circumferentially in the axial direction. Following an encapsulation or extrusion coating of a plastic material of the plastic body onto the region of the flat contact, the flat contact is displaced in the direction of its tapering(s) against the extrusion coating. This displacement causes cavities of the encapsulated region of the flat contact to be closed along the outer surfaces of the tapered contour. The fluid-tight via is thereby sealed axially along the encapsulated region of the flat contact.

The sealing of the cavities during the displacement of the flat contact arises from contraction of the plastic material during cooling. Thermoplastic materials, in particular, change their internal structure during cooling which causes a reduction in the material volume. This after-shrinkage leads to a small gap in the flat contact which is sealed in the manner described. The attainable degree of sealing is often not sufficient under adverse environmental conditions such as high pressures and temperatures.

Challenging environmental conditions are encountered by connector parts built into vehicle transmission housings. Such connector parts are exposed to varying and high temperature differences and have to withstand vibrations and high oil pressures. In such applications, plug-in connectors with rounded pins are typically used. The round pins are inserted under high pressure into through-holes of a corresponding part. The through-holes have slightly smaller dimensions compared to the cross-sectional dimensions of the round pins.

Such a procedure is problematic when used with flat contacts instead of round pins. This is because pressure forces inside a through-hole do not act symmetrically over the surface of a flat contact. The seal in the region of the long edges of the flat contact is especially difficult to produce since the direction of the normal to the surface changes discontinuously. As a result, adequate oil tightness has not yet been achieved for transmission housing pin connectors with flat contacts for the typically encountered temperature and pressure ranges.

DE 10 2011 121 133 (corresponds to U.S. Publication No. 2014/0256167) describes a fluid-tight via whose plastic body includes a non-shrinking, duroplast material and for which the longitudinal edges of the encapsulated flat contact(s) are rounded. A fluid-tight via is thus obtained by the combination of a specifically selected encapsulation material and a specially designed flat contact(s). Both features taken together create a fluid-tight via that can even be gas-tight over a defined pressure region. Nevertheless, the gas-tight attribute is restricted to pressures that are not too high, depending on the type of gases.

SUMMARY

An object is a plug-in connector (e.g., a via) having flat contacts in which the connector is fluid-tight, gas-tight, and vibration and chemical resistant in high pressure and temperature environments over a large temperature range.

In carrying out at least one of the above and/or other objects, a fluid-tight via is provided. The fluid-tight via includes a plastic body, a flat contact(s), and a permanently elastic sealant. The plastic body includes a non-shrinking, duroplastic material. The flat contact has an intermediate region encapsulated by the plastic body. The intermediate region of the flat contact has a cross-sectional width which varies along an axial direction of the flat contact. The permanently elastic sealant fills cracks in interfaces between the plastic body and the flat contact.

The permanently elastic sealant may be introduced into the interfaces by vacuum impregnation or by pressure impregnation. The impregnation of the permanently elastic sealant into the interfaces may occur after the duroplastic material of the plastic body has hardened to encapsulate the intermediate region of the flat contact.

Embodiments are directed to a fluid-tight contact implementation (i.e., a fluid-tight via) through a plastic body that includes one or more flat contacts. Each flat contact has an intermediate region between two opposite end sections. The intermediate regions of the flat contacts have one or more cross-sectional changes. The plastic body encapsulates the intermediate regions of the flat contacts. The plastic material of the plastic body is a non-shrinking thermoset material. A permanently elastic seal material is between the plastic body and the flat contacts.

Thus, embodiments include a combination of features of: (i) the plastic body being made from a non-shrinking, duroplastic (thermoset) material; and (ii) a permanently elastic seal filling cracks in interfaces between the plastic body and the flat contacts.

The permanently elastic seal is of a material which retains its elastic property over relatively long time intervals and over relatively large temperature ranges. For the permanently elastic seal, a low-viscosity elastomeric base material is used in the formation of the via which elastomeric base material then hardens into the permanent elastic seal.

As described, a duroplastic material is used for the encapsulation or extrusion coating of the plastic body applied onto the flat contacts. In comparison with conventional thermoplastics used for injection molding, duroplastic materials which do not experience a reduction in volume while curing, but remain unchanged or even expand can be used. For the problem to be solved here, non-shrinking, duroplastic materials, also known as "non-shrinkers," which neither shrink nor expand are especially well suited. Such materials can be found, for example, in the groups of epoxy resins, phenol resins, or the so-called bulk molding compounds (BMC). The use of such a non-shrinking, duroplastic material enables a flat contact to be extruded without the formation of gaps during the curing of the extrusion coating duroplastic material.

However, even for a non-shrinking, duroplast material, the formation of microscopically small micro-cracks, capillaries, etc., in the plastic material of the plastic body or in the transition region (i.e., the interface) between the plastic body and the flat contacts cannot be excluded. Such micro-cracks, capillaries, etc., limit the gas tightness of the via to relatively lower pressures.

Embodiments solve the problem caused by unavoidable miniscule leaks that arise during the encapsulation process by subsequently sealing the leaks with the applied elastomeric material. To this end, so-called impregnation procedures are suitable that move a not yet hardened elastomeric binder into the places (e.g., cracks, capillaries, etc.) in the plastic material of the plastic body and/or in the interfaces between the plastic body and the flat contacts to be sealed by pressure differences.

This can for example occur by placing a via having one or more flat contacts that are encapsulated with a non-shrinking duroplast material in a bath with a not yet solidified elastomeric binder. The elastomeric binder is then subjected to a high pressure whereby the elastomeric binder itself penetrates into the narrow cracks, capillaries, etc. of the via.

A so-called vacuum impregnation technique may be employed in which all moisture and gas cavities are first removed from the cracks, capillaries, etc. of the via, so that the elastomeric binder can then penetrate into the cracks, capillaries, etc. in a problem-free impregnation step.

In order to assure a uniform connection between the duroplastic material and the flat contacts during the encapsulation process, the longitudinal edges of the flat contacts are initially rounded prior to the flat contacts being extruded through the duroplastic material to be encapsulated by the duroplastic material. This is achieved by embossing the raw longitudinal edges of the flat contacts using a stamping process and thereby rounding the edges circumferentially. The flat contacts thus do not exhibit a precisely rectangular cross-sectional shape, but rather a rectangular cross-section with rounded transitions between the sides of the cross-section.

Each flat contact also has one or more rectangular-shaped or rounded cavities or recesses on edge sections of the extrusion coated region of the flat contact. The cross-sectional widths of the flat contacts thus vary in the axial direction of the flat contacts.

The cavities or recesses of a flat contact cause the flat contact to bond to the extrusion coating material after the flat contact is extruded in a form fitting manner. The cavities or recesses form a labyrinth structure in the axial direction of the flat contact. The labyrinth structure gives rise to a multi-stage pressure drop around the bordering material, whereby the sealing properties of the fluid-tight via are further improved. A contributing feature of the extrusion coating material is that its material volume does not change during processing. The extrusion coating thereby tightly fills the cavities or recesses of the flat contact.

In an embodiment, the flat contacts and the extrusion coating material are as similar as possible in terms of characteristics. For instance, the flat contacts and the extrusion coating material have at least similar temperature expansion coefficients. In this way, mechanical stresses and gap formation, which diminish the sealing properties, are prevented over a broad temperature range.

In an embodiment, the two end sections of each flat contact are exposed and are not encapsulated by the plastic body. As such, the end sections of the flat contact do not have thereon the extrusion coating material which forms the plastic body. The remaining region of the flat contact between the end sections of the flat contact (i.e., the intermediate region of the flat contact) is encapsulated by the plastic body. Thereby, this remaining intermediate region of the flat contact does have thereon the extrusion coating material which forms the plastic body. The non-encapsulated end sections of the flat contacts are treated by a galvanic process without affecting the extrusion coated intermediate region of the flat contact. This enables favorable sealing properties and high temperature tolerance. In this way, the extrusion coated intermediate region and the non-extrusion coated ends of the flat contact have different galvanic coatings. Such differences between the intermediate region and the end sections of the flat contact are especially beneficial.

Thus, for example, it can be advantageously provided that only the non-extrusion coated end sections of the flat contact have a tin or silver coating.

For this purpose, the flat contacts which are not surface treated, and possibly those treated with an anti-tarnishing material, can be encapsulated or extruded initially during the production sequence. Subsequently, the flat contacts projecting out from the ends of the plastic body are surface treated and possibly passivated. Treating only the end sections of the flat contacts achieves the additional benefit of reducing the use of silver and the passivation agent.

The above features, and other features and advantages of embodiments of the present invention are readily apparent from the following detailed description thereof when taken in connection with the accompanying drawings.

DETAILED DESCRIPTION

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
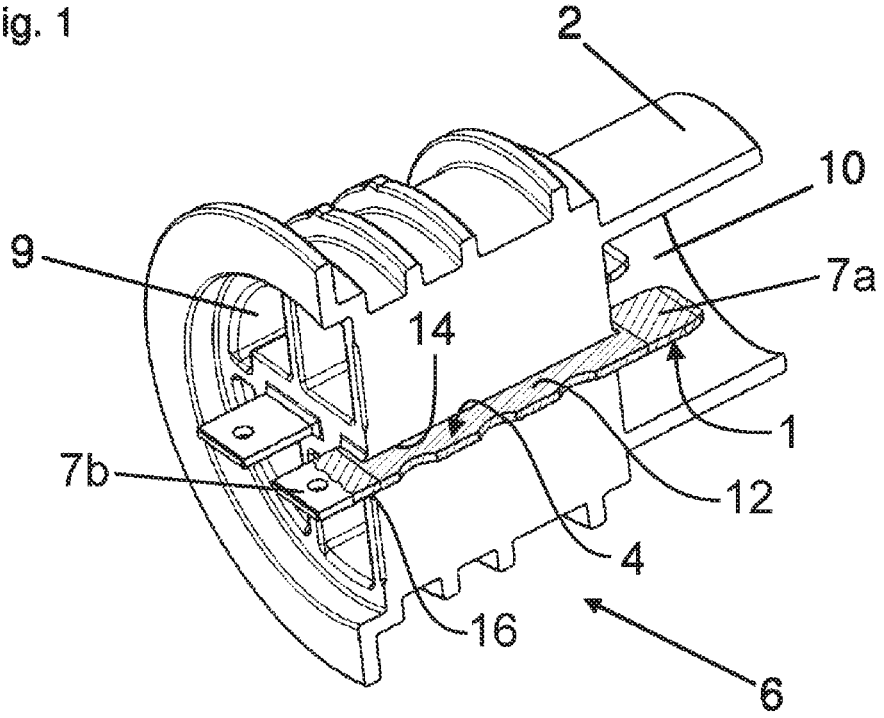
FIG. 1 illustrates a section view of a fluid-tight via having a plastic body and a plurality of flat contacts.

Referring now to FIG. 1, a fluid-tight contact implementation (i.e., a fluid-tight contact via) is shown. The contact implementation is in the form of a plug-in connector 6. Connector 6 includes a plastic body 2 and flat contacts 1. Connector 6 has a fluid-tight feed-through of flat contacts 1 between opposite end chambers 9 and 10. In this regard, plastic body 2 encapsulates intermediate regions 4 of flat contacts 1. As shown in FIG. 1, the end sections 7*a*, 7*b* (labeled in FIG. 4) of flat contacts 1 are not encapsulated by plastic body 2.

Connector 6 is fabricated as an injection molded part. Intermediate regions 4 of flat contacts 1 are extruded with the plastic material forming plastic body 2 to be encapsulated by the plastic body during the fabrication process and thereby form connector 6. The plastic material forming plastic body 2 is a non-shrinking, duroplast (thermoset) material.

Figure 2:
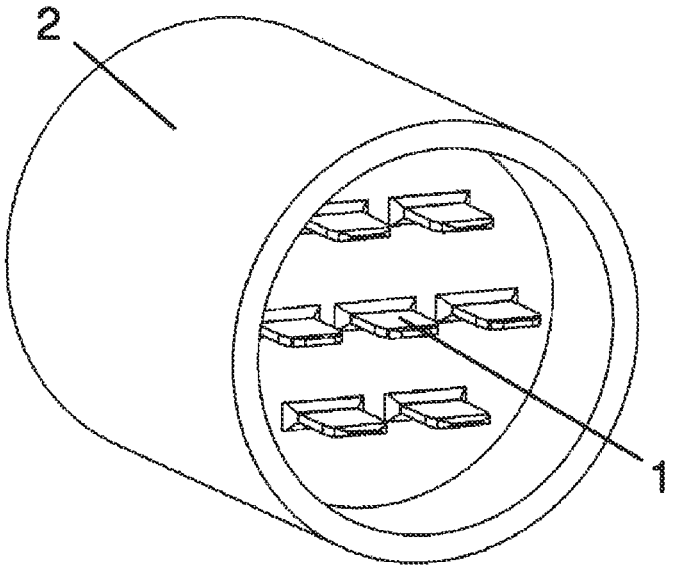
FIG. 2 illustrates a perspective view of a fluid-tight via having a different amount of multiple flat contacts.

Connector 6 shown in FIG. 1 is an example of a two-pole, fluid-tight contact implementation. This is because connector 6 has two flat contacts 1. The fluid-tight contact implementation may have a freely selectable amount of flat contacts 1 including one or more flat contacts 1. For example, FIG. 2 illustrates a fluid-tight contact implementation having seven flat contacts 1. These flat contacts 1 are arranged in three parallel rows with respect to one another.

During the fabrication of connector 6, subsequent to intermediate regions 4 of flat contacts 1 being encapsulated with the plastic duroplast material forming plastic body 2, the connector is placed in a bath of a not yet hardened elastomeric binder (not shown). The bath of elastomeric binder is then subjected to high pressure whereby an elastomeric binder 12 (i.e., a permanently elastic sealant) is pressed into the finest remaining interstices (i.e., cracks, capillaries, etc.) of an interface 14 between plastic body 2 and flat contacts 1.

Alternatively or additionally, a vacuum impregnation technique is used in which all moisture and gas cavities are first removed from the cracks or capillaries of connector 6 so that the elastomeric binder 12 can then penetrate into the cracks or capillaries in a problem-free impregnation step.

Figure 3:
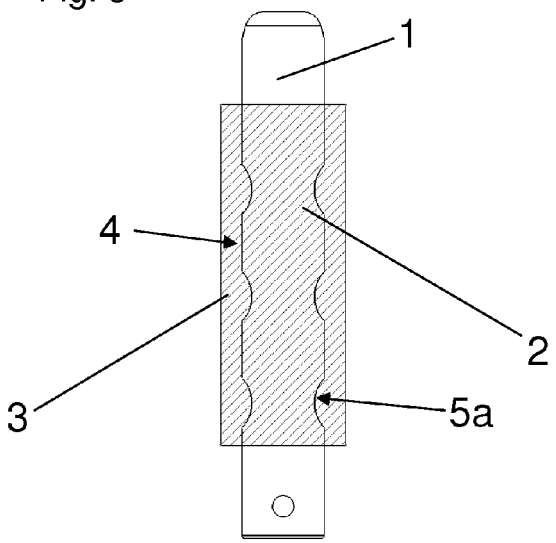
FIG. 3 illustrates a planar view of a flat contact having an extrusion coated intermediate region and non-extrusion coated end sections with the intermediate region having rounded recesses or cavities.

Referring now to FIG. 3, with continual reference to FIGS. 1 and 2, a planar view of a flat contact 1 is shown. Flat contact 1 (or flat pin) includes an intermediate region 4 and end sections 7*a*, 7*b* (labeled in FIG. 4) at respective ends of the intermediate region. Intermediate region 4 is coated with an extrusion coating 3 of plastic material forming plastic body 2. Again, the plastic material forming plastic body 2 is a non-shrinking, duroplast material. As such, extrusion coating 3 is a non-shrinking, duroplast coating. The hatched area schematically shows extrusion coating 3 for a partial volume of plastic body 2 that directly encloses intermediate region 4 of flat contact 1. As a result, intermediate region 4 is an extrusion coated (or encapsulated) intermediate region of flat contact 1 and the end sections are non-extrusion coated (or non-encapsulated) end sections of flat contact 1.

Intermediate region 4 of flat contact 1 includes rounded recesses or cavities ("recesses") 5*a*. Rounded recesses 5*a* are formed in the longitudinal sides of flat contact 1 at various locations along the axial direction (length) of flat contact 1. As such, intermediate region 4 includes a plurality of cross-sectional changes or modifications in the form of rounded recesses 5*a*.

Intermediate region 4 with rounded recesses 5 is encapsulated by extrusion coating 3 of plastic material forming plastic body 2. Thus, rounded recesses 5*a* formed in the longitudinal sides of flat contact 1 are within or inside of extrusion coating 3. Extrusion coating 3 makes a bond in a form fitting manner with recesses 5*a*. The bond is fluid-tight over a broad temperature and pressure region due to the "non-shrinking" properties of the duroplastic material that is used for extrusion coating 3.

Figure 4:
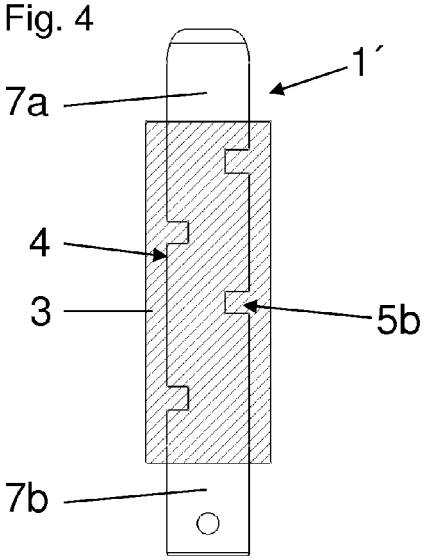
FIG. 4 illustrates a planar view of a flat contact having an extrusion coated intermediate region and non-extrusion coated end sections with the intermediate region having rectangular shaped recesses or cavities.

Referring now to FIG. 4, with continual reference to FIG. 3, a planar view of a flat contact 1' in accordance with another embodiment of the present invention is shown. Again, the hatched area schematically shows extrusion coating 3 for a partial volume of plastic body 2 that directly encloses intermediate region 4 of flat contact 1'. As a result, intermediate region 4 is an extrusion coated (or encapsulated) intermediate region of flat contact 1' and end sections 7*a*, 7*b* of flat contact 1' are non-extrusion coated (or non-encapsulated) end sections of flat contact 1'.

In comparison with flat contact 1 as shown in FIG. 3, intermediate region 4 of flat contact 1' includes rectangular shaped recesses or cavities 5*b*. Rectangular shaped recesses 5*b* are formed in the longitudinal sides of flat contact 1' at various locations along the axial direction (length) of flat contact 1'. Again, extrusion coating 3 makes a bond in a form fitting manner with recesses 5*b*. The bond is fluid-tight over a broad temperature and pressure region due to the "non-shrinking" properties of the duroplastic material that is used for extrusion coating 3.

Non-extrusion coated end sections 7*a*, 7*b* of flat contacts 1 and 1' can be galvanically treated after the extrusion process. For example, it is possible to improve the electrical conductivity properties with a coating 16 of tin or silver (shown in FIG. 1).

Figure 5:
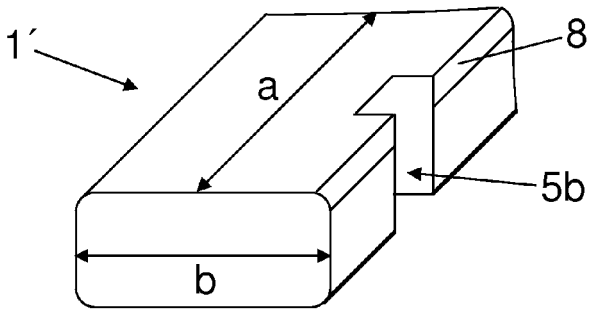
FIG. 5 illustrates a perspective cross-sectional view of a segment of the intermediate region of the flat contact shown in FIG. 4.

Referring now to FIG. 5, with continual reference to FIG. 4, a perspective cross-sectional view of a segment of intermediate region 4 of flat contact 1' is shown. One of rectangular shaped recesses 5*b* is shown in FIG. 5. As further shown in FIG. 5, the cross-sectional width "b" of flat contact 1' varies in its axial direction "a" through rectangular shaped recess 5*b*.

Longitudinal edges 8 extending in the axial direction "a" of flat contact 1' are rounded. Rounded longitudinal edges 8 of flat contact 1' are molded by embossing flat contact 1' on the side to be stamped on the raw edge. Rounded longitudinal edges 8 of flat contact 1' shown in FIG. 4 or flat contact 1 shown in FIG. 3 significantly improve the bonding of flat contact 1' to extrusion coating 3.

REFERENCE SYMBOLS

1, 1' flat contact (pin)
2 plastic body
3 encapsulation or extrusion coating
4 intermediate region of flat contact
5*a* rounded recesses of intermediate region of flat contact
5*b* rectangular recesses of intermediate region of flat contact
6 plug-in connector housing
7*a*, 7*b* end sections of flat contact
8 longitudinal edges of flat contact
9, 10 chambers
a axial direction of flat contact
b cross-sectional width of flat contact While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A fluid-tight contact comprising:

a plastic body including a non-shrinking, duroplastic material;

a flat contact having an intermediate region encapsulated by the plastic body, the intermediate region of the flat contact having a cross-sectional width which varies along an axial direction of the flat contact, wherein longitudinal edges of the intermediate region of the flat contact along the axial direction are rounded;

the flat contact further has end sections at opposite ends of the intermediate region of the flat contact, wherein the end sections are not encapsulated by the plastic body;

the intermediate region of the flat contact includes recesses which vary the cross-sectional width of the intermediate region along the axial direction without varying a cross-sectional height of the intermediate region along the axial direction; and a permanently elastic sealant fills in an interface between the plastic body and the intermediate region of the flat contact.

2. The fluid-tight contact of claim 1 wherein:

the permanently elastic sealant is introduced into the interface by vacuum impregnation.

3. The fluid-tight contact of claim 1 wherein:

the permanently elastic sealant is introduced into the interface by pressure impregnation.

4. The fluid-tight contact of claim 1 wherein:

the permanently elastic sealant is introduced into the interface after the duroplastic material of the plastic body has hardened to encapsulate the intermediate region of the flat contact.

5. The fluid-tight contact of claim 1 wherein:

the plastic body and the flat contact have at least similar thermal expansion coefficients.

6. The fluid-tight contact of claim 1 wherein:

the plastic body forms a plug-in connector housing.

7. The fluid-tight contact of claim 1 wherein:

the contact is a multiple pole plug-in connector having a plurality of flat contacts.

8. The fluid-tight contact of claim 1 wherein:

the non-encapsulated end sections of the flat contact are treated by a galvanic process and the encapsulated intermediate region of the flat contact is not treated by the galvanic process.

9. The fluid-tight contact of claim 1 wherein:

the non-encapsulated end sections of the flat contact include at least one of a tin and silver coating and the encapsulated intermediate region of the flat contact does not include either a tin or silver coating.

10. The fluid-tight contact of claim 1 wherein:

the longitudinal edges of the flat contact are embossed in a stamping process on a raw edge and thereby rounded circumferentially.

11. The fluid-tight contact of claim 1 wherein:

the plastic body further includes an epoxy resin, a phenol resin, or a bulk molding compound with non-shrinking properties.

* * * * *